US005760748A

United States Patent [19]

Beckingham

[11] Patent Number: 5,760,748

[45] Date of Patent: Jun. 2, 1998

[54] PIVOTING SUPPORT BRACKET TO MOUNT A GPS ANTENNA ABOVE A THEODOLITE OR A TOTAL STATION MOUNTED ON A TRIPOD

[75] Inventor: Michael Beckingham, Birkenhead, New Zealand

[73] Assignee: Trimble Navigation Limited, Sunnyvale, Calif.

[21] Appl. No.: 654,040

[22] Filed: May 28, 1996

[51] Int. Cl.[6] ..... H01Q 3/00

[52] U.S. Cl. ..... 343/765; 343/882; 343/892; 248/177.1; 248/186.2; 356/4.06

[58] Field of Search ..... 343/700 MS, 765, 343/878, 882, 892; 248/183, 278, 661, 117.1, 186.2; 356/4.06; 342/52

[56] References Cited

U.S. PATENT DOCUMENTS

| | | | |
|---|---|---|---|
| 2,475,746 | 1/1947 | Kenyon | 343/882 |
| 2,827,629 | 3/1958 | Rounsefell | 343/892 |
| 4,037,229 | 7/1977 | Dunk | 343/882 |
| 4,290,574 | 9/1981 | Archibald | 248/177.1 |
| 5,077,557 | 12/1991 | Ingensand | 342/52 |
| 5,170,197 | 12/1992 | Schmidt et al. | 248/186.2 |
| 5,212,493 | 5/1993 | Cluniat et al. | 343/882 |
| 5,233,357 | 8/1993 | Ingensand et al. | 342/352 |
| 5,419,521 | 5/1995 | Matthews | 343/882 |
| 5,453,756 | 9/1995 | Lowrey | 343/878 |
| 5,614,918 | 3/1997 | Dinardo et al. | 343/882 |

FOREIGN PATENT DOCUMENTS

| | | | |
|---|---|---|---|
| 0101506 | 6/1983 | Japan | 343/878 |

*Primary Examiner*—Hoanganh T. Le
*Assistant Examiner*—Tan Ho
*Attorney, Agent, or Firm*—Thomas E. Schatzel; Law Offices of Thomas E. Schatzel A Prof. Corp.

[57] ABSTRACT

A surveying instrument comprises a tripod with a tribrach that receives both a theodolite and a C-bracket that half vertically encircles the theodolite. The C-bracket and the theodolite are each independently pivotable on the same vertical axis and the C-bracket is able to completely orbit around the theodolite such that it can be positioned so as not to optically interfere with the use of the theodolite. The top of the C-bracket provides a mount for a navigation satellite receiver antenna that positions the axis of rotation of the C-bracket through the electrical center of the antenna.

8 Claims, 2 Drawing Sheets

PIVOTING SUPPORT BRACKET TO MOUNT A GPS ANTENNA ABOVE A THEODOLITE OR A TOTAL STATION MOUNTED ON A TRIPOD

BACKGROUND OF THE INVENTION

1. Field of the Invention

The invention relates generally to survey instruments and more specifically to global positioning system devices for attachment to theodolites or total stations for optical, combined optical and electronic surveys.

2. Description of the Prior Art

Relatively crude instruments were once used for land surveying. Surveyors used simple optical theodolites or transits to determine the horizontal azimuth angles and the vertical elevation angles between survey points. Chains and tape measures were used to measure the distance between a theodolite and a point to be established. Telescopic devices, e.g., horizontal levels, and graduated rods were also used to determine the actual elevation of a point or location from a reference.

Surveying has advanced considerably. Laser light and infrared beams are now used in combination with retro-reflective devices, such as corner cube prisms, in the determination of precise distances. The beams are reflected back by the retro-reflective devices as parallel collinear beams of energy back to the receiver/transmitter. Phase angle measurements and timing circuits allow the exact distance between the transmitter and reflector to be precisely determined and displayed. Such electronic instruments have greatly improved the accuracy that is possible by a surveyor in the taking of measurements and the setting of points. Typically, these electronic distance measuring devices are used to provide range measurements to remotely located reflecting devices or prisms that may be as far away as two or three thousand feet.

Electronic measuring devices have been combined with conventional transit/theodolite instruments and levels, and vertical collimators, into a combination instrument called a total station. Well known manufacturers of these instruments include such companies as Sokkia, Geotronics, Zeiss, Topcon and Leica. The total station ordinarily includes an optical telescope in the theodolite which has a standard magnification of thirty power. Total stations can visually measure vertical, as well as horizontal, angles and can perform the calculations required by a surveyor. The corner cube prisms are mounted or supported on a prism pole or tripod and held or controlled by a surveyor's associate. Two leveling bubbles are typically mounted on the pole or tripod and positioned in intersecting planes to aide the associate in holding the prism in a vertical position. One of the problems with this type of prism has been the inability of the surveyor to accurately sight the center of the prism when it is a considerable distance from the total station. A number of enlarged planar visual targets having various types of sighting indicia or patterns painted or embossed on the face of the target are attached to or positioned to surround the prism to aide the surveyor in sighting the retro-reflective device. In order to be able to properly use the prism it is necessary to position the prism and target perpendicular to the line of sight of the total station and to extrapolate the alignment center of the visual target which essentially causes the surveyor to guess at the exact center of the target which is usually occupied by the prism. This type of target and the fact that the instrument requires the use of the reflective prism creates a number of inaccuracies in the sighting function that is performed by the total station and in turn the work performed by the surveyor.

A theodolite and tape have traditionally been used to measure horizontal and vertical angles and distances in terrestrial surveying. Digital theodolites, as described in U.S. Pat. No. 3,768,911, issued to Erickson, and electronic distance meters (EDMs), as described by Hines, et al., in U.S. Pat. No. 3,778,159, have supplanted the theodolite and tape approach. Combinations of optical angle encoders and EDM in integrated packages called "electronic total stations", have led to automation of field procedures, plan production and design work. See, U.S. Pat. No. 4,146,927, issued to Erickson et al.

In geodetic surveying, or geodesy, distances and angles can be measured by electro-optical methods to determine the positions of measuring points in a relevant coordinate system. Conventional electro-optical distance measuring instruments transmit a modulated light beam of infrared light, which is reflected from a prism of cubical configuration placed on the target point for the purpose of taking measurements. The light reflected by the prism is received and phase-detected, thereby enabling the distance to be determined with great accuracy. The vertical angle and horizontal direction to the target point can also be determined electrically or electro-optically. The measuring instrument is allowed to take repeated measurements and to continuously determine the position of a moving target, where the measuring instrument is directed onto the target manually.

Retro-reflective surveyor instruments, such as corner cube prisms, are striped along the reflective surfaces to provide an internal visual center target. The precise center of the prism is identified by the visual target which allows the prism to be used both for distance measuring purposes as well as visual alignment for the one step setting of surveying points or locations. The corner cube prism has the ridges of the intersecting reflective surfaces on the back of the prism striped or lined either with a stripe having equal thickness or tapered towards the center apex of the prism. The stripes are formed with a highly visible paint, ink, tape, or sheet material. This arrangement produces a highly visible visual center target. The prism target can be mounted in an enclosed case and the case can be rigidly mounted or tiltably mounted on a horizontal axis to tilt the prism in a vertical direction for use in mountainous terrain. A large exterior target and mount can be provided for centrally mounting the prism and case and tilting mounting the exterior target with the prism so that the two can move together. The tilt axis of the exterior target and prism target are aligned to pass along the front face of the target and through a hypothetical forward offset plane within the prism upon which the visual center target appears to lie.

Several limitations existed in use of conventional total stations. First, it was difficult to quickly establish the angular orientation and absolute location of a local survey or datum. Many surveys are not related to a uniform datum, but exist only on a localized datum. In order to accurately orient a survey to a global reference, such as astronomical north, a star observation for azimuth is often used that requires long and complicated field procedures. Second, if a survey is to be connected to a national or state geodetic datum, the survey sometimes must be extended long distances, such as tens of kilometers, depending upon the proximity of the survey to geodetic control marks. Third, the electronic total station relies upon line-of-sight contact between the survey instrument and the rodman or pole carrier, which can be a problem in rough terrain.

One electronic total station instrument for surveying, and measuring elevation differences, is disclosed by Wells, et al., in U.S. Pat. No. 4,717,251. A rotatable wedge is positioned along a surveying transit line-of-sight, and is arranged to be parallel to a local horizontal plane. As the wedge is rotated, the line-of-sight is increasingly diverted until the line-of-sight passes through a target. The angular displacement is then determined by electro-optical encoder means, and the elevation difference is determined from the distance to the target and the angular displacement. This device can be used to align a line-of-sight from one survey transit with another survey transit or to a retro-reflector.

Nakamura, et. al., describe in U.S. Pat. No. 5,475,395, issued Dec. 12, 1995, a reflecting mirror and a microstrip antenna for receiving signals from GPS satellites. The reflecting mirror is supported by a base that can swing on a horizontal axis and rotate on a vertical axis. The antenna is supported above the reflecting mirror on a bearing with a vertical axis that is coaxial with the vertical axis of the reflecting mirror. The antenna is then supplemented with a reflecting mirror. The reflecting mirror is rotated on the vertical axis to point in the direction of an electronic distance meter or total station that can accurately determine the distance and angle.

A surveying instrument that uses the global positioning system (GPS) measurements for determining the location of a terrestrial site that is not necessarily within a line-of-sight of the surveyor is disclosed in U.S. Pat. No. 5,077,557, issued to Ingensand. The instrument uses a GPS signal antenna, receiver and processor combined with a conventional electro-optical or ultrasonic range finder and a local magnetic field vector sensor at the surveyor's location. The range finder is used to determine the distance to a selected mark that is provided with a signal reflector to return a signal issued by the range finder to the range finder. The magnetic field vector sensor is apparently used to help determine the surveyor's location and to determine the angle of inclination from the surveyor's location to the selected mark.

Ingensand states that the object of his invention is to permit the surveying of points with the aid of a satellite system that are not situated in the direct range of sight of the satellites. An instrument solution to this problem includes a non-contact measuring range finder that can be tilted and combined with a satellite receiver in a "geometrically unambiguously defined relative position". The operation of the instrument involves a remote measuring point which is aimed at with a sighting device and a vertical setting of the instrument is simultaneously monitored with the aid of a vertical sensor. An optical range finder is disposed, in the example, directly below the GPS satellite receiver that permits measurements of distances to remote points fitted with reflectors.

However, the GPS satellite receiver, or at least its antenna, can optically interfere with the optical range finder at some azimuths because they are both mounted on the same plumb rod.

Ingensand, et al., describe in U.S. Pat. No. 5,233,357, issued Aug. 3, 1993, a surveying system that includes an electro-optic total station and a portable satellite position-measuring receiver system. Ingensand, et al., explains that because the quasi-optic propagation characteristics of the waveband chosen for the GPS transmission system, good reception of the satellite signals requires that the receiving antenna be visible to the satellites. Such reception can be interrupted by obstacles such as plant cover, buildings, etc. Signal loss can cause measurement errors or prevent operation entirely. The assumption is the GPS signals at the total station may be inadequate. The approach taken is to provide a wireless data transmission system for coupling a satellite position measuring system with better signal reception location to a total station to transmit position data to the total station. But such a loose collection of equipment is not very easy to use and is time-consuming to setup and breakdown.

What is needed is a bracket and system for using a high accuracy GPS survey receiver and antenna in conjunction with an optical total station. Since this usually means that the electrical center of the GPS antenna and the optical center of the total station must have a zenith-nadir relationship, the GPS antenna must be lofted in such a way on the total station that its support does not interfere with the optical tasks.

SUMMARY OF THE PRESENT INVENTION

It is therefore an object of the present invention to provide a navigation satellite receiver antenna at a strategic point on a total station surveying instrument.

It is another object of the present invention to provide a surveying instrument with a navigation satellite receiver antenna that is centered perpendicularly above a theodolite electronic distance meter or electronic total station.

Briefly, a surveying instrument of the present invention comprises a tripod with a tribrach that receives both a theodolite or total station and a C-bracket that half vertically encircles the theodolite. The C-bracket and the theodolite are each independently pivotable on the same vertical axis and the C-bracket is able to completely orbit around the theodolite such that it can be positioned so as not to optically interfere with the use of the theodolite or total station. The top of the C-bracket provides a mount for a navigation satellite receiver antenna that positions the axis of rotation of the C-bracket through the electrical center of the antenna.

An advantage of the present invention is that a navigation satellite receiver antenna is provided with a mount on a theodolite or total station that can be moved out of the optical path of the theodolite without adversely affecting the strategic position of the antenna.

Another advantage of the present invention is that a surveying instrument is provided with a navigation satellite receiver antenna that is centered perpendicularly above a theodolite electronic distance meter of total station.

These and other objects and advantages of the present invention will no doubt become obvious to those of ordinary skill in the art after having read the following detailed description of the preferred embodiment that is illustrated in the drawing figures.

IN THE DRAWINGS

DETAILED DESCRIPTION OF THE PREFERRED EMBODIMENT

Figure 1:
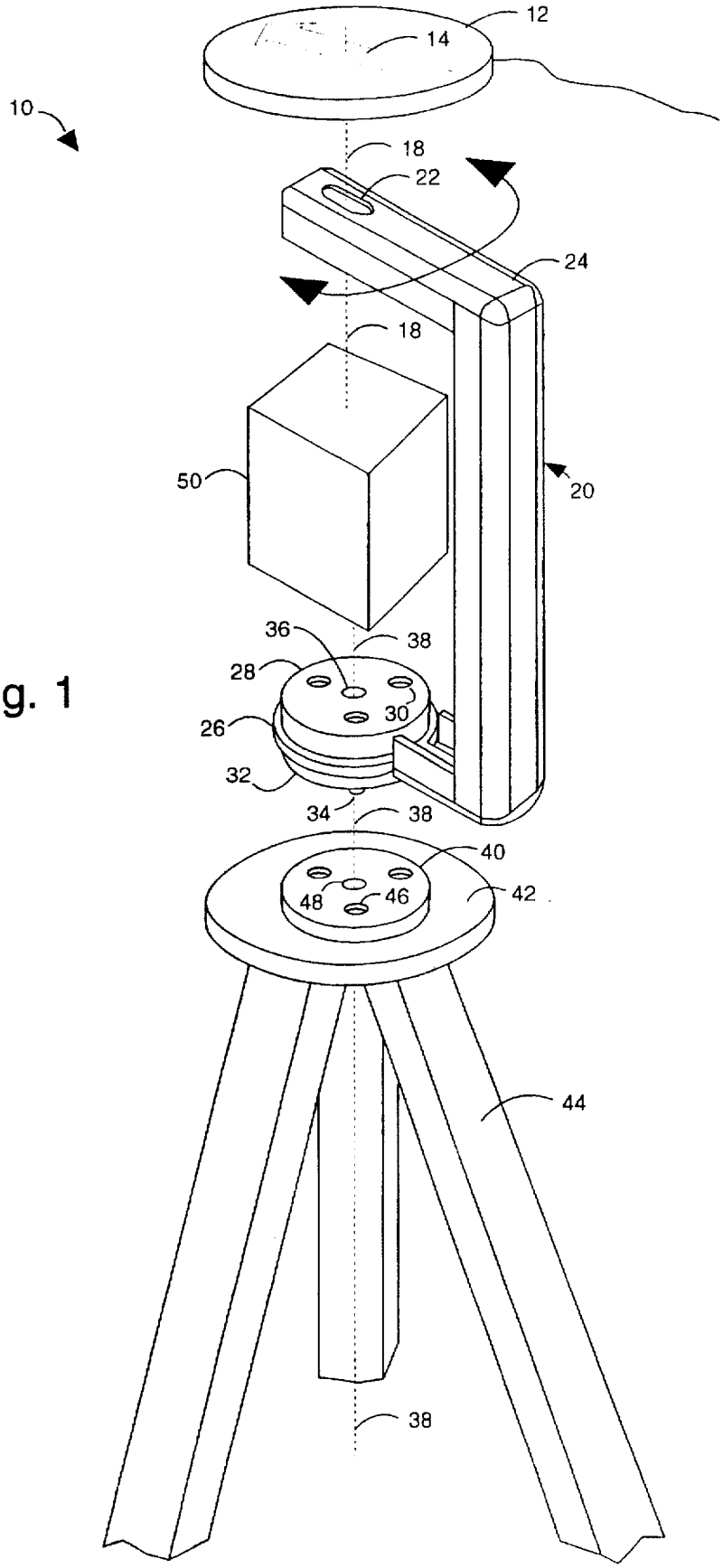
FIG. 1 is an exploded assembly view of a survey instrument embodiment of the present invention.

FIG. 1 illustrates a survey instrument embodiment of the present invention, referred to herein by the general reference numeral 10. A global position system (GPS) receiver antenna 12 is provided to receive L-band microwave radio transmissions from orbiting GPS satellites. Antenna 12 is preferably a microwave patch antenna that includes a low noise amplifier (LNA). The antenna and LNA 12 are connected to a survey-quality satellite positioning system receiver and computer, e.g., SITE SURVEYOR™ and TRIMTALK™ products marketed by Trimble Navigation Limited (Sunnyvale, Calif.). The antenna 12 has an orientation direction 14 that can be matched with the orientation directions of other GPS antennas in a survey system to maximize performance and increase accuracy. The antenna 12 has an electrical center that is intersected by an axis 18. The antenna 12 mounts to a bracket 20 with a bolt hole 22 provided on an upper arm 24. The bracket 20 includes a ring bearing 26 attached to a tribrach receptacle 28 that allows the bracket 20 to freely rotate 360° around the axis 18. The tribrach receptacle 28 includes a set of three pin holes 30 that include locking blades that clamp any matching inserted pins. The tribrach receptacle 28 is fixed to a tribrach plug 32 which includes a set of three locking pins 34. A central hole 36 clear through the tribrach receptacle 28 and plug 32 allows for the use of an optical plumb along a sightline 38. The axis 18, the sightline 38, and the rotation of the ring bearing 26 are all coaxial. The tribrach plug 32 can be detached from, and locked into, a matching receptacle 40 that is mounted to a tripod 42 with a set of three legs 44. A set of three pin holes 46 exactly match the pins 34. A hole 48 continues a clear line of sight for sightline 38 to a survey point on the ground over which the tripod 42 is positioned.

An optical survey instrument 50, e.g., a theodolite, electronic distance meter (EDM) or total station, is pivotably mounted within the volume swept by the bracket 20. For example, the optical survey instrument 50 may comprise a commercial survey instrument product as marketed by PTS series by Pentax (Englewood, Colo.), TOP GUN total stations and DTM-700 series field stations by Nikon (Japan), ELTA 50 routine total stations by Zeiss (Thornwood, N.Y.), GTS-200/500/700 series by Topcon (Paramus, N.J.), POWERSET by Sokkia (Japan), etc.

In operation, the optical survey instrument 50 and the pivot bracket 20 each are independently free to turn 360° on the same axis 18. The body of the pivot bracket 20 is preferably rotated by the intended user to any position that does not optically interfere with the optical survey instrument 50. The body of the pivot bracket 20 may also be rotated by the user to a position in which orientation direction 14 is favorable for overall GPS accuracy. The electrical center of the antenna 12 is positioned to be intersected by the axis 18, therefore the rotation of the pivot bracket 20 has little or no effect on the X, Y, Z electronic position of the antenna 12.

Figure 2A:
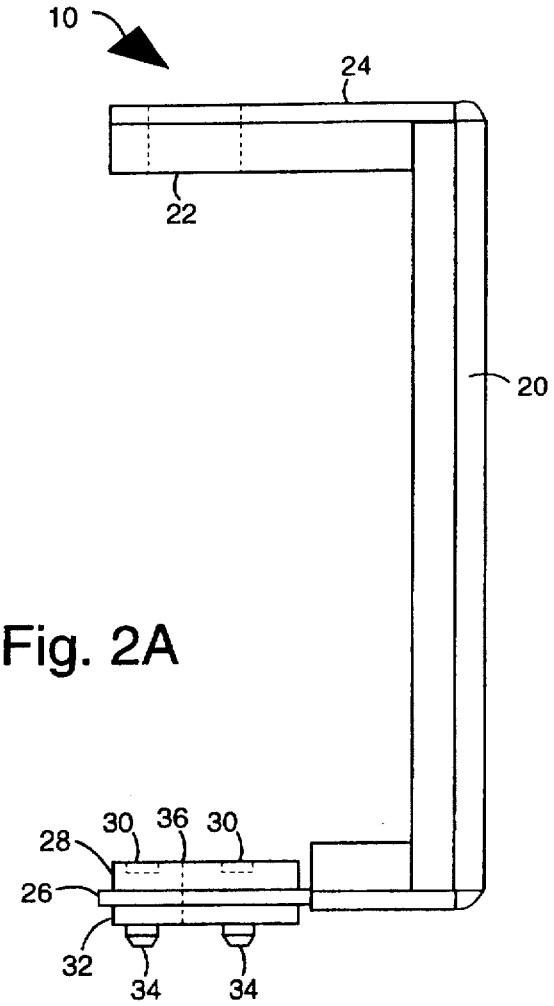
FIG. 2A is a first side view of the pivotable C-bracket included in the instrument of FIG. 1.
Figure 2B:
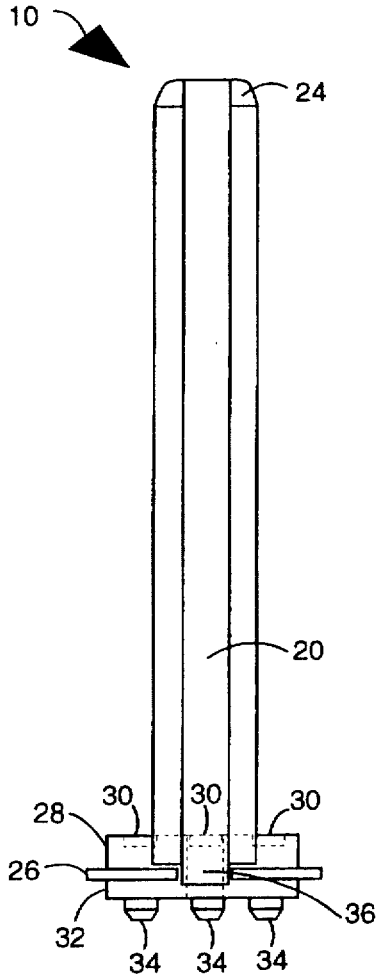
FIG. 2B is a second side view orthogonal to the first side view of the pivotable C-bracket included in the instrument of FIG. 1.
Figure 2C:
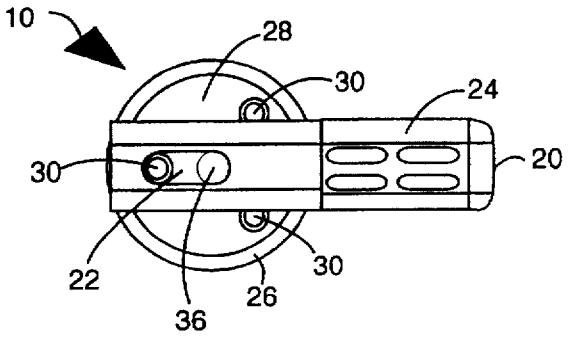
FIG. 2C is a bottom view of the pivotable C-bracket included in the instrument of FIG. 1.

FIGS. 2A, 2B and 2C show the pivot bracket 20 includes top end 24 for mounting the antenna and LNA 12, body 20 and bottom ring 26. The top end 24 includes slot 22 that provides a modest amount of freedom in the exact positioning of the antenna. The bottom ring bearing 26, tribrach receptacle 28, tribrach plug 32, pin holes 30 and locking pins 34 are configured to rotate with a minimum of wobble. Preferably, the bottom ring 26 is dimensioned to fit in between commercially available optical survey instruments designed for tribrach mounting and the corresponding tribrach mount. Thus, the bottom ring 26 is preferably clamped between the optical survey instrument 50 and the level base 42 in a manner that allows the optical survey instrument 50 to be directly attached to the level base 42, e.g., with or without the pivot bracket 20 and antenna and LNA 12.

In general, the top end 24 provides a surface that is perpendicular to the axis 18 for mounting a hemispherical response antenna, such as patch antenna 12. The receiving hemisphere of the antenna's response is preferably oriented during use to receive signals from any orbiting GPS satellite visible between the horizons of the four points of the compass.

Although the present invention has been described in terms of the presently preferred embodiment, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A survey instrument, comprising:

a pivoted support having a pair of parallel opposite first and second ends that share a common axis of rotation and a connecting body that orbits clear of a reserved volume which is centrally intersected by said common axis and that rigidly connects said ends together;

a microwave antenna mounted coaxial to said common axis and on said first end and electrically directed 180° away from said second end and providing for the reception of signals transmitted overhead from a plurality of orbiting navigation satellites; and a level base connected to the pivoted support at said second end and providing for the pivotal mounting of a theodolite on one side within said reserved volume and between said pair of parallel opposite first and second ends and having three-point level mounting on another side to a surveyor tripod;

wherein said connecting body of the pivoted support can be freely rotated to any position around said theodolite to correct a visual interference of the pivoted support to said theodolite.

2. The instrument of claim 1, wherein:

the level base includes a tribrach mount that provides for simple assembly and disassembly of said theodolite.

3. The instrument of claim 1, wherein:

said second end of the pivoted support includes a ring that is clamped between said theodolite and the level base that allows said theodolite to be directly attached to the level base without disturbing the microwave antenna.

4. A bracket, comprising:

an antenna platform having a planar mounting surface perpendicular to an axis of rotation;

a pivot support end having a ring parallel to said surface of the antenna platform; and a C-type connecting body with a distal end that joins to the antenna platform and a near end that joins to the pivot support end and having a body connected between that orbits entirely outside a reserved volume that is disposed in between said distal and near ends and that is centrally intersected by said axis of rotation.

5. The bracket of claim 4, wherein:

the antenna platform includes a slot for fastening a navigation satellite receiver antenna and that provides for the adjustment of an electrical center of said antenna to intersect said axis of rotation.

6. The bracket of claim 4, wherein:

said ring of the pivot support end provides for directly clamping a theodolite to a level base through an inner diameter of said ring.

7. The bracket of claim 6, wherein:

said ring, said theodolite and said level base provide for the independent coaxial rotation in said level base of the antenna platform, pivot support and connecting body, in unison, and said theodolite.

8. A bracket, comprising:

an antenna platform having a surface perpendicular to an axis of rotation, and including a slot for fastening a navigation satellite receiver antenna and that provides for the adjustment of the electrical center of said antenna to intersect said axis of rotation;

a pivot support end having a ring parallel to said surface of the antenna platform; and a C-type connecting body with a distal end that joins to the antenna platform and a near end that joins to the pivot support end and having a body connected between that orbits entirely outside a reserved volume that is disposed in between said distal and near ends and that is centrally intersected by said axis of rotation;

wherein, said optical survey instrument is disposed within said reserved volume;

wherein, said ring of the pivot support end provides for directly clamping an optical survey instrument to a level base through the inner diameter of said ring; and wherein, said ring, said optical survey instrument and said level base provide for the independent coaxial rotation in said level base of the antenna platform, pivot support and connecting body, in unison, and said optical survey instrument.

* * * * *